US007404285B2

(12) United States Patent
Burchert et al.

(10) Patent No.: US 7,404,285 B2
(45) Date of Patent: Jul. 29, 2008

(54) ADAPTER FOR A TRASH REMOVAL OPENING OF AN OPEN END SPINNING MACHINE

(75) Inventors: Mathias Burchert, Ostifldern (DE); Siegfried Krohmer, Beuren (DE); Michael Basting, Suessen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 159 days.

(21) Appl. No.: 11/472,273

(22) Filed: Jun. 22, 2006

(65) Prior Publication Data

US 2006/0277893 A1 Dec. 14, 2006

Related U.S. Application Data

(63) Continuation of application No. 10/842,687, filed on May 11, 2004, now abandoned.

(30) Foreign Application Priority Data

May 12, 2003 (DE) ..... 103 22 392
Sep. 30, 2003 (DE) ..... 103 47 480

(51) Int. Cl.
*D01H 4/08* (2006.01)

(52) U.S. Cl. ..... 57/404

(58) Field of Classification Search ..... 57/404–417
See application file for complete search history.

(56) References Cited

U.S. PATENT DOCUMENTS 5,398,494 A * 3/1995 Wassenhoven et al. ..... 57/408
6,295,800 B1 * 10/2001 Stahlecker ..... 57/411

FOREIGN PATENT DOCUMENTS

DE 19 22 078 4/1969
DE 42 25 668 8/1992

* cited by examiner

*Primary Examiner*—Shaun R. Hurley
(74) *Attorney, Agent, or Firm*—Crowell & Moring LLP

(57) ABSTRACT

An exchangeable adapter is provided for reducing the size of a trash removal opening of an opening roller housing in open-end spinning arrangements. The said adapter comprises two semi-spherical supporting surfaces at a distance to one another for positioning the adapter on corresponding rounded countersurfaces. The adapter comprises further a curved fiber guiding surface corresponding to the curve of an opening roller as well as a boundary wall for reducing the size of the trash removal opening arranged directly upstream of the fiber guiding surface. The adapter is made from profiled bars and cut to the required effective width. The fiber guiding surface can be provided with a recess which is connected with the external atmosphere and which permits the entry of air into the opening roller housing.

10 Claims, 4 Drawing Sheets

19
16
17
20
18
x
23

19
27
17
29
20
18
28
x

ADAPTER FOR A TRASH REMOVAL OPENING OF AN OPEN END SPINNING MACHINE

This application claims the priority of German applications 103 22 392.4, filed May 12, 2003, and 103 47 480.3, filed Sep. 30, 2003, the disclosures of which are expressly incorporated by reference herein.

BACKGROUND AND SUMMARY OF THE INVENTION

The present invention relates to an exchangeable adapter for open-end spinning arrangements for reducing a trash removal opening of an opening roller housing, said adapter comprising two semi-circular supporting surfaces for clamping the adapter onto corresponding curved countersurfaces, also comprising a curved fiber guiding surface corresponding to the curve of an opening roller, and comprising a boundary wall for reducing the size of the trash removal opening, said boundary wall being arranged directly upstream of the fiber guiding surface.

Trash removal openings in opening roller housings for open-end spinning arrangements are standard in the industry today. They serve on the one hand to separate the trash particles from the opened fiber material. On the other hand, the trash removal openings are simultaneously used as openings to feed in the necessary air required for the spinning process. Both processes are known in the spinning industry. It has been shown, however, that such trash removal openings can present unnecessary problems in the transport of some fiber materials, in particular when relatively clean fiber material is to be spun or when the opened single fibers are so short that there is a risk that fiber material will also be expelled. In particular in the processing of linen or regenerative material, trash removal openings can present a problem.

It was known early on in German published patent 19 22 078 to provide trash removal openings with a regulatory closing piece which is adapted to the shape of the wall of the opening roller housing and with which the trash removal opening can be partly or entirely closed.

It is known in German published patent application 42 25 668 to border the trash removal opening on its exit side with a trash guiding wall which can be swivelled. By means of positioning the trash guiding wall at different angles, various air currents are known to be produced.

Both these variations are very complicated and have not found any place in practical use.

An exchangeable adapter for open-end spinning arrangements for reducing the size of a trash removal opening of an opening roller housing is known from prior notorious use in a machine built for use in the spinning industry, said prior use being undocumented. The preamble of the main claim of the present invention is based on such an adapter. The known adapter comprises two semi-circular supporting surfaces arranged at a distance to one another, with which the adapter can be clamped onto corresponding curved countersurfaces which border a trash removal opening on its exit side. The known adapter comprises a curved fiber guiding surface with corresponds to the curve of the opening roller, which fiber guiding surface extends the periphery wall of the opening roller housing surrounding the opening roller, thus reducing the size of the trash removal opening. The known adapter comprises further a boundary wall, arranged directly upstream of the fiber guiding surface, at the end of the trash removal opening.

Exchangeable adapters of this type can be applied to the opening roller housings as required or removed therefrom. This can be done by hand, and as a rule, tools are not needed. The known adapter has the disadvantage, however, that because of its method of fabrication, it is not suitable for being produced in large numbers, as it is made by means of milling its contours. It is also not suitable for permitting the feeding of air outside of the reduced trash removal opening.

It is an object of the present invention to create an adapter of the above mentioned type, which can be manufactured cost-effectively in large numbers, and which also permits the feed of air for the spinning process if required.

This object is achieved in that the adapter is fabricated from profiled bars and cut to match the required effective width of the fiber guiding surface and the boundary wall.

In the case of the profiled bars, an extruded, open profile made of light metal is preferably involved here, which comprises the necessary outer contours. These comprise on the one hand the necessary supporting surfaces for clamping the adapter onto countersurfaces as well as the necessary fiber guiding surface and the boundary wall. The profiled bars, produced in long lengths, are cut according to the required effective width of the opening roller housing, whereby minor re-working, for example, deburing, is subsequently necessary on the front sides. The effective width of the fiber guiding surface and the boundary wall have such dimensions that the adapter can be inserted flush between the lateral walls of the opening roller housing. Due to the special method of production, the supporting surfaces are as wide as the fiber guiding surface and the boundary wall. The profile is so designed that the fiber guiding surface graduates into boundary wall with a distinctive radius.

As exchangeable adapters according to the present invention can be manufactured cost-effectively in large numbers, it is possible to have adapters with various profiles to hand in a spinning mill. For example, a complete set of different adapters can be provided with which the trash removal opening on the opening roller housing can be reduced in size in a variety of ways.

Independently of the manufacturing process, that is, also applicable with the known adapter, it can be provided that the fiber guiding surface is provided with a recess which permits the entry of air, said recess being connected to the external atmosphere. Thus a type of by-pass opening is created which generates, in addition to the air fed through the trash removal opening, a further opening for the feeding of additional air for the spinning process, but without any fibers being expelled therefrom.

As expelled trash particles travel at a high speed and are very aggressive, it is advantageous when the fiber guiding surfaces and the boundary wall of the adapter, including the transition area between them, are provided with a wear-resistant coating.

If the bars do not consist of light metal, but rather are made from a plastic injection moulded part, a coating for the prevention of wear on the surface is indispensable. The coating can be a metal alloy or ceramic.

As the opening roller, provided with a needle or saw-toothed combing means, and located in the opening roller housing, can hinder the removal of the adapter, it can be advantageous in a further embodiment of the present invention when the adapter is provided with a web on its side facing away from the fiber guiding surface, said web comprising an engaging surface for a removal tool. In the case of such an engaging surface, a simple bore hole can be involved here. In the case of an appropriate embodiment of the adapter and its supporting surfaces, dismantling the adapter can, as a rule, take place without the use of a tool. The bore hole can serve at the same time to connect the above mentioned recess to the external atmosphere.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
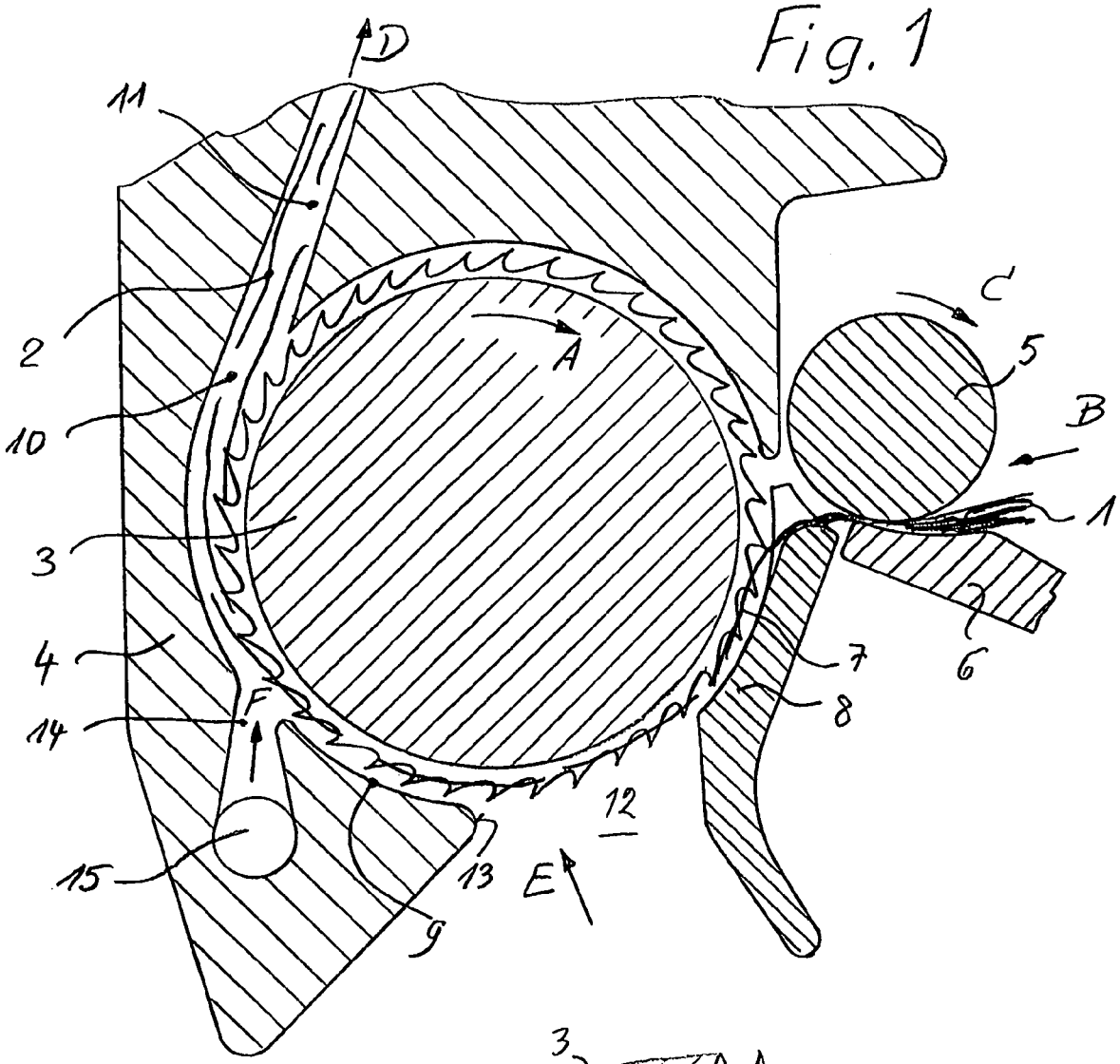
FIG. 1 is an intersection of a side view of an opening roller housing without an adapter.

FIG. 1 shows an arrangement in which the adapter according to the present invention is not yet inserted. This arrangement serves to open fed, sliver-like fiber material 1 to single fibers 2 and comprises an opening roller 3 which is fitted with a toothed combing means, which opening roller 3 rotates in rotational direction A in an opening roller housing 4.

The fiber material 1 is fed in feed direction B by means of a feed roller 5 rotating in rotational direction C to the opening roller 3. A feed table 6 is pressed against the periphery of the feed roller 5 in the known way, the swivel axle and weighting spring of said feed table 6 are not shown. The feed roller 5 presents the sliver-like fed fiber material 1 to the combing means of the opening roller 3 in the form of a fiber beard 7, out of which the single fibers 2 are opened.

The fiber beard 7 is held to the combing means of the opening roller 3 by means of a fiber beard support 8, which can be a part of the opening roller housing 4. The fiber beard support 8 and remaining parts of the opening roller housing 4 form a circumferential wall 9 which surrounds the periphery of the opening roller 3. This circumferential wall 9 is positioned so close to the combing means of the opening roller 3 that the single fibers 2 transported by the opening roller 3 remain in the combing means until they reach a fiber delivery point 10. A fiber feed channel 11, connected to a vacuum source, is arranged downstream of the fiber delivery point 10 in the known way, via said fiber feed channel 11 the single fibers 2 are fed to a twist device (not shown), for example an open-end spinning rotor.

A known trash removal opening 12, provided as standard, is located between the fiber beard support 8 and the fiber delivery point 10 in the circumferential wall 9, which trash removal opening 12 is, as a rule, connected to the external atmosphere, whereby the air E is fed to the fiber feed channel 11. The trash removal opening 12 is bordered in transport direction of the single fibers 2 by a removal edge 13, from which point the circumferential wall 9 is continued.

Between the removal edge 13 and the fiber delivery point 10 a further air inlet opening 14 is advantageously provided, at which in flow-in direction F in addition to the in-coming air E, further in-coming air is fed. In the opening roller housing 4 an air channel 15 is provided for additional air.

As mentioned above, there are certain fiber materials, for example linen or regenerated materials, for which trash removal openings 12 having the usual dimensions are more disadvantageous. For this reason, it is provided in FIG. 2 that the trash removal opening 12 is reduced in size by means of an exchangeable adapter 16, which is manufactured from profiled bars and cut to the required effective width in a way described below.

Figure 2:
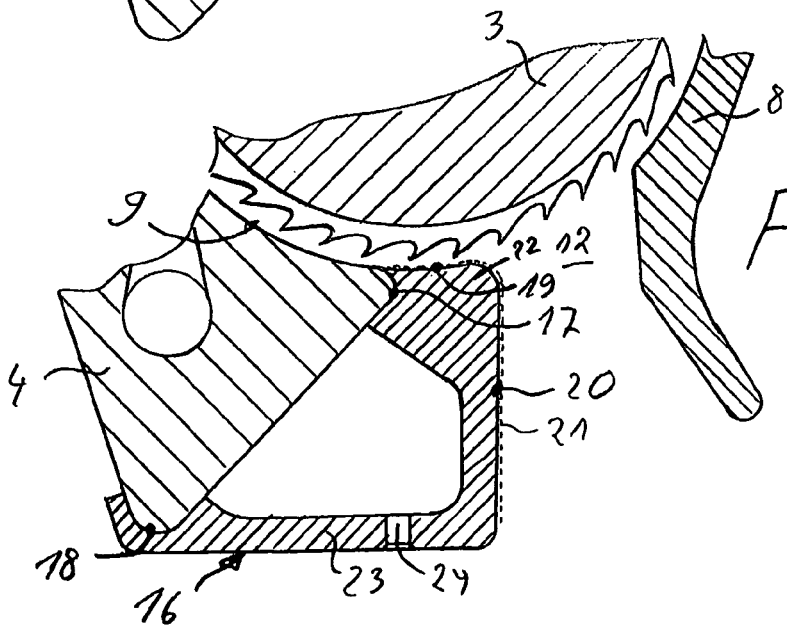
FIG. 2 is a partial view of FIG. 1 in the area of a trash removal opening, which is reduced in size by means of a clamped-on adapter.

In FIG. 2, a part of the opening roller 3 can be seen, further the opening roller housing 4 having a circumferential wall 9 and a fiber beard support 8 and the reduced trash removal opening 12. The exchangeable adapter 16 comprises two semi-circular supporting surfaces 17 and 18 which are at a distance to one another, with which, as can be seen, the adapter 16 can be clamped onto corresponding curved countersurfaces of the opening roller housing 4. The adapter 16 comprises a curved fiber guiding surface 19 which corresponds to the curve of the opening roller 3, which fiber guiding surface 19 extends continuously the circumferential wall 9 of the opening roller housing 4, and which graduates at a curved transition area 22 into a boundary wall 20, which closes the reduced trash removal opening 12 on its exit side.

As can be seen in FIG. 2 and denoted by a dotted line, the fiber guiding surface 19 and the boundary wall 20, including the transition area 22, can be provided with a wear-resistant coating 21.

It can be provided further that the adapter 16 is provided with a web 23 on its side facing away from the fiber guiding surface 19, which web 23 comprises an engaging surface 24, for example a bore hole, for a tool for disassembling the adapter 16.

Figure 3:
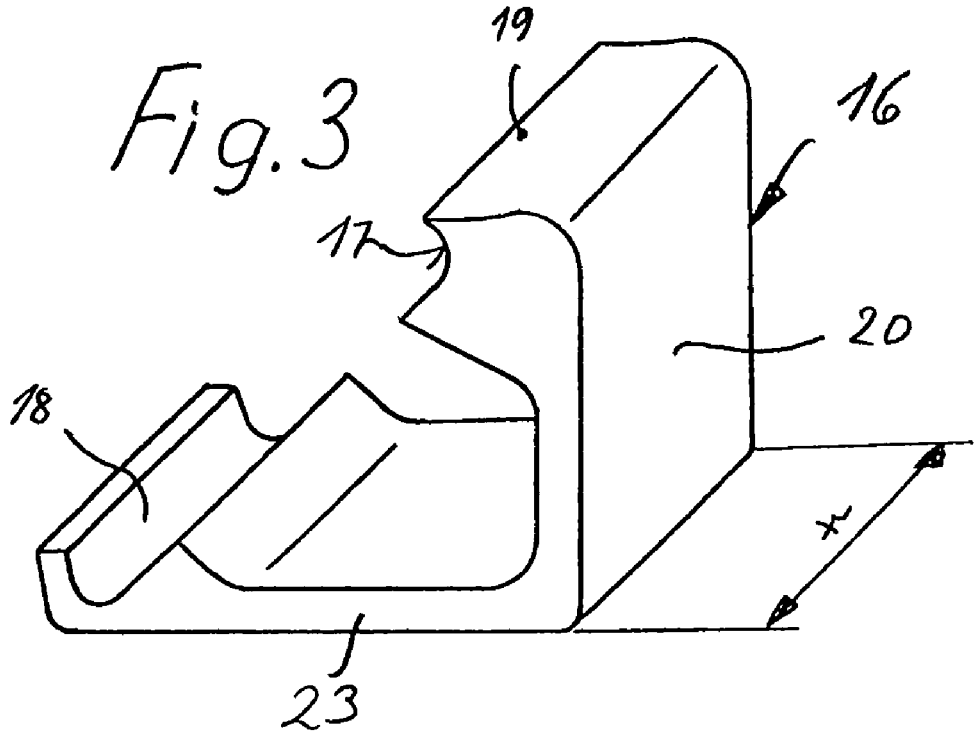
FIG. 3 is a perspective view of a clampable adapter.

In FIG. 3 an adapter 16 is perspectively shown. The supporting surfaces 17 and 18 can be seen, further the fiber guiding surface 19, the boundary wall 20 as well as the web 23, in this case without a bore hole for a tool. The effective width of the adapter 16 is denoted by the letter x. This relates first and foremost to the fiber guiding surface 19 and the boundary wall 20, but also, due to the manufacturing process thereof, to the supporting surfaces 17 and 18.

Figure 4:
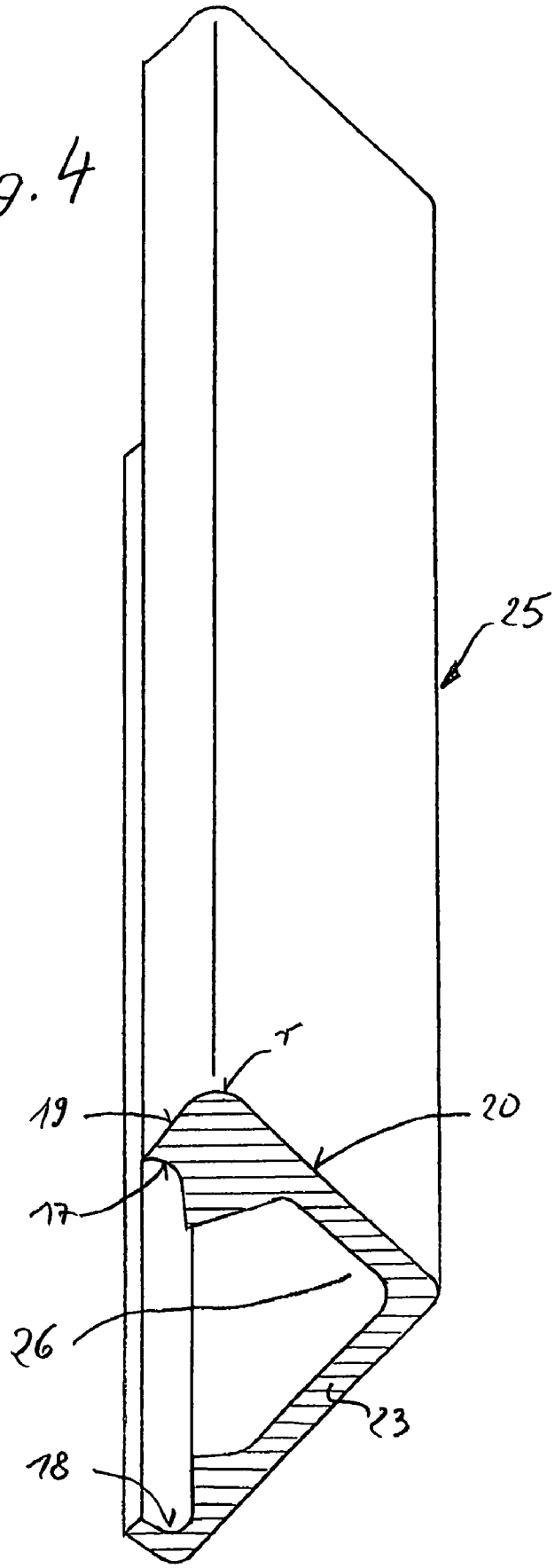
FIG. 4 is a profiled bar having a longer length, from which the adapter according to the present invention is produced by means of cutting.

In FIG. 4 a part of a long profiled bar 25 is shown perspectively, which is cut into the individual adapters 16 having the required effective width x, the front sides of the adapter 16 having thereafter minor re-working. The distinctive radius r between the fiber guiding surface 19 and the boundary wall 20 can also be seen.

The profiled bars 25 are preferably extruded out of a light metal. This permits the profiles with the desired contours to be made. The recess 26 seen in FIG. 4 of the open profile does not have any practical function and could well have a different form.

Figure 5:
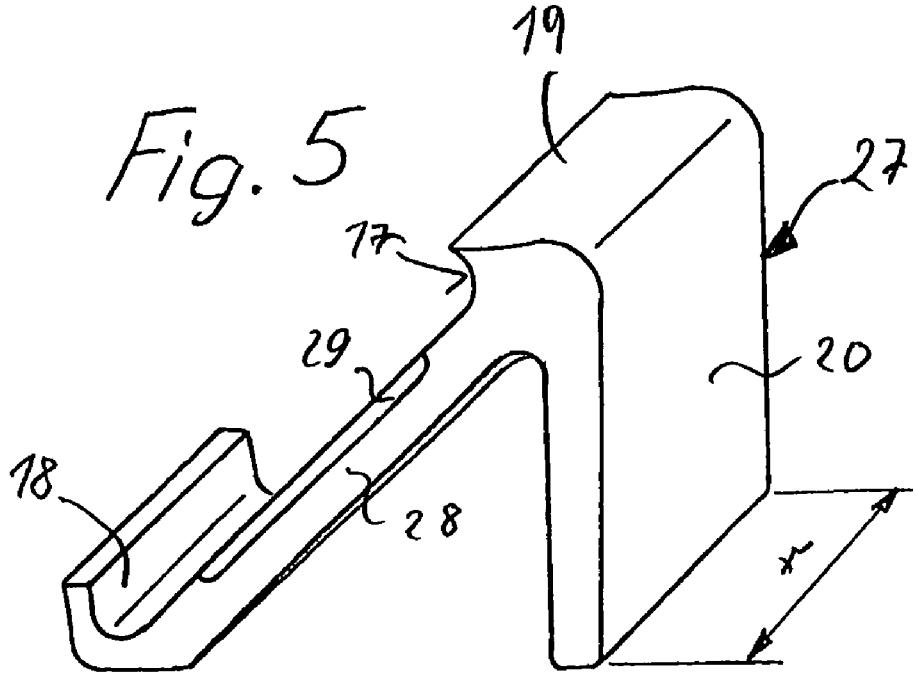
FIG. 5 is a perspective depiction similar to FIG. 3 of another embodiment of an adapter.

Such a different embodiment of the profile can be seen in the adapter 27 of FIG. 5. This differently designed adapter 27 comprises both supporting surfaces 17 and 18, as described above, as well as the fiber guiding surface 19 and the boundary wall 20. The profile has, however, a different design, in particular the web 23 seen in FIG. 3 is missing. Instead another web 28 is present between the supporting surfaces 17 and 18, which web 28 comprises a small recess 29 between the supporting surfaces 17 and 18. This altered adapter 27 is also made from profiled bars and cut to the desired effective width x.

Figure 6:
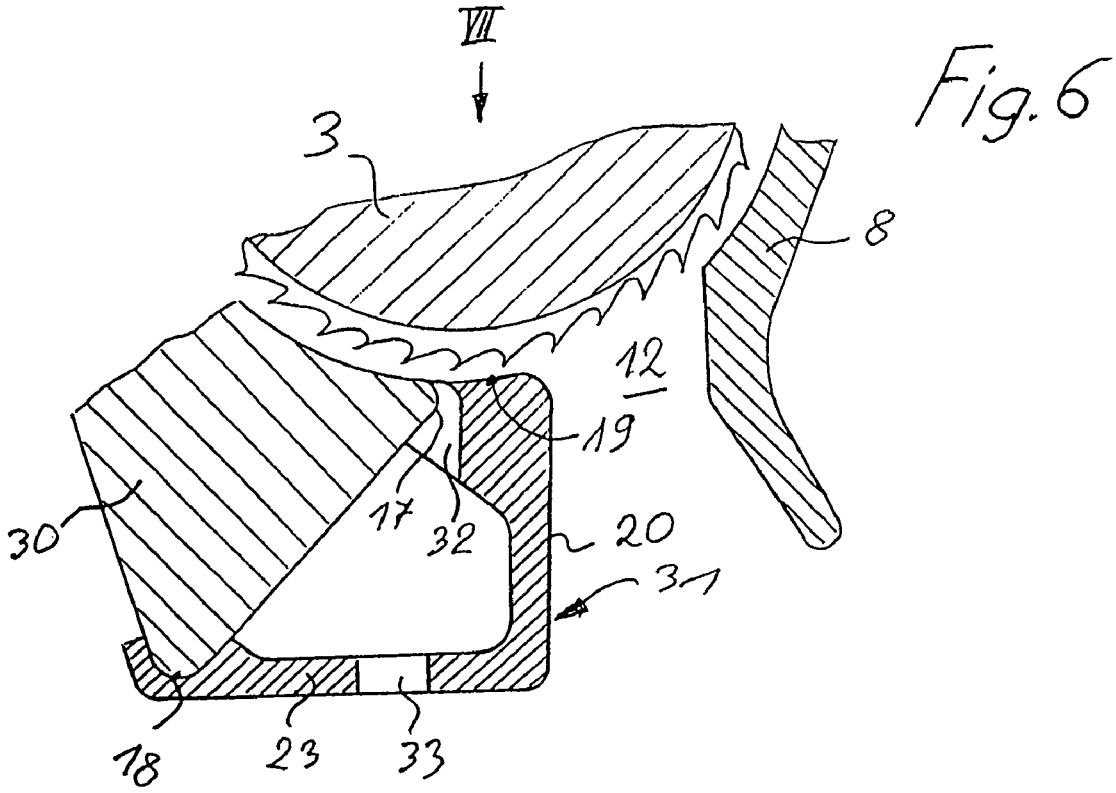
FIG. 6 is another embodiment of an adapter which permits the feeding of air.
Figure 7:
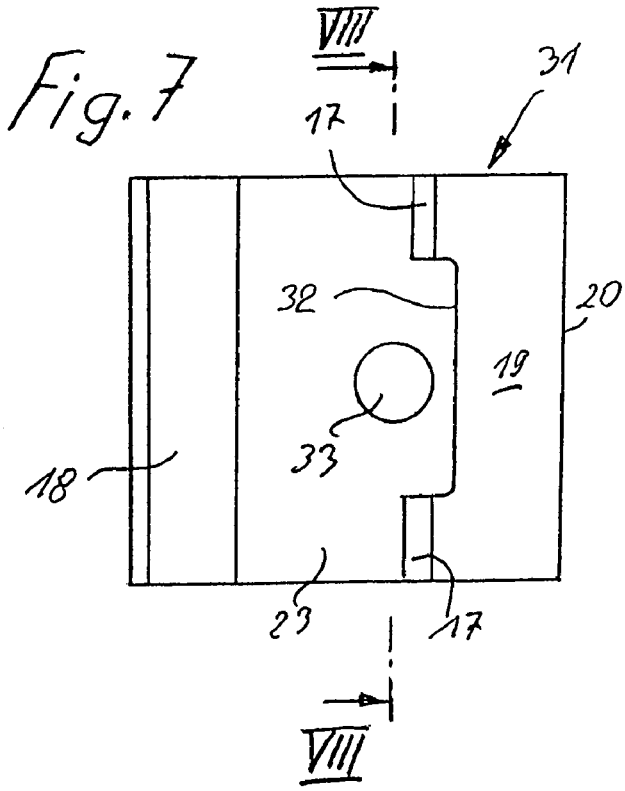
FIG. 7 is a view of the adapter in the direction of arrow VII of FIG. 6.
Figure 8:
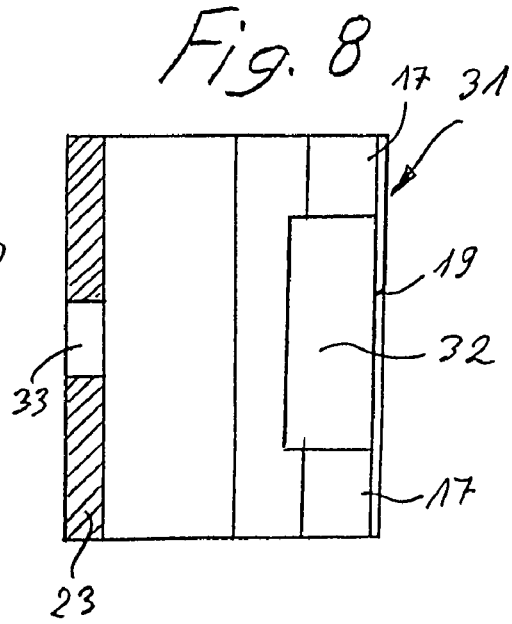
FIG. 8 is a view of the adapter along the intersectional surface VIII-VIII of FIG. 7.

With the aid of FIGS. 6 to 8, a further embodiment of an adapter 31 is described, which does not necessarily have to be made according to the process described above and which can be preferably applied to open roller housings 30 which do not comprise the addition air opening 14 described above according to FIG. 1. Adapters 31 of this type differ also in design from the above acknowledged prior art.

On the one hand, the reduction in size of the trash removal opening 12 by means of the adapter 31 avoids the above mentioned disadvantages during spinning of certain types of fiber material, on the other hand it reduces the amount of additional air, insofar as this is fed in to a great extent through the trash removal opening. Further advantage can be gained when, according to the present invention, the adapter 31 in the fiber guiding surface 19 comprises a recess 32, which permits the entry of additional air. The connection to the external atmosphere is ensured by an additional air opening 33 located in the web 23.

What is claimed is:

1. Exchangeable adapter for open-end spinning arrangements for reducing a trash removal opening of an opening roller housing, said adapter comprising two semi-circular supporting surfaces for clamping the adapter onto corresponding curved countersurfaces, also comprising a curved fiber guiding surface corresponding to the curve of an opening roller, and comprising a boundary wall for reducing the size of the trash removal opening, said boundary wall being arranged directly upstream of the fiber guiding surface, wherein the adapter is made from profiled bars and cut to the required effective width (x) of the fiber guiding surface and the boundary wall, and wherein the fiber guiding surface and the boundary wall, including the transition area between them, are provided with a coating.

2. Exchangeable adapter for open-end spinning arrangements for reducing a trash removal opening of an opening roller housing, said adapter comprising two semi-circular supporting surfaces for clamping the adapter onto corresponding curved countersurfaces, also comprising a curved fiber guiding surface corresponding to the curve of an opening roller, and comprising a boundary wall for reducing the size of the trash removal opening, said boundary wall being arranged directly upstream of the fiber guiding surface, wherein the adapter is made from profiled bars and cut to the required effective width (x) of the fiber guiding surface and the boundary wall, and wherein said adapter is provided on its side facing away from the fiber guiding surface with a web, which comprises an engaging surface for a disassembling tool.

3. Adapter according to claim 1, wherein said adapter is provided on its side facing away from the fiber guiding surface with a web, which comprises an engaging surface for a disassembling tool.

4. Exchangeable adapter for open-end spinning arrangements for reducing a trash removal opening of an opening roller housing, said adapter comprising two semi-circular supporting surfaces for clamping the adapter onto corresponding curved countersurfaces, comprising a rounded fiber guiding surface corresponding to the curve of an opening roller, and comprising a boundary wall for reducing the size of the trash removal opening, said boundary wall being arranged directly upstream of the fiber guiding surface, wherein the fiber guiding surface is provided with at least one recess leaving a gap to the opening roller housing for permitting the entry of air, said recess being connected to the external atmosphere.

5. An exchangeable adapter for reducing a trash removal opening of an opening roller housing, comprising:

two semi-circular supporting surfaces for clamping the adapter onto corresponding curved countersurfaces of the roller housing;

a curved fiber guiding surface corresponding to the curve of an opening roller; and a boundary wall for reducing the size of the trash removal opening, said boundary wall being arranged directly upstream of the fiber guiding surface, wherein the adapter is made from a profiled bar, and wherein the fiber guiding surface and the boundary wall meet at a transition area.

6. The adapter according to claim 5, wherein the fiber guiding surface, the boundary wall and the transition area are provided with a wear-resistant coating.

7. An exchangeable adapter for reducing a trash removal opening of an opening roller housing, comprising:

two semi-circular supporting surfaces for clamping the adapter onto corresponding curved countersurfaces of the roller housing;

a curved fiber guiding surface corresponding to the curve of an opening roller; and a boundary wall for reducing the size of the trash removal opening, said boundary wall being arranged directly upstream of the fiber guiding surface, wherein the adapter is made from a profiled bar, and wherein said adapter is provided on a side facing away from the fiber guiding surface with a web into which a disassembling tool may be engaged for removal of the adapter from the roller housing.

8. The adapter according to claim 6, wherein said adapter is provided on a side facing away from the fiber guiding surface with a web into which a disassembling tool may be engaged for removal of the adapter from the roller housing.

9. An exchangeable adapter for reducing a trash removal opening of an opening roller housing, comprising:

two semi-circular supporting surfaces for clamping the adapter onto corresponding curved countersurfaces of the roller housing;

a curved fiber guiding surface corresponding to the curve of an opening roller; and a boundary wall for reducing the size of the trash removal opening, said boundary wall being arranged directly upstream of the fiber guiding surface, wherein the adapter is made from a profiled bar, wherein the adapter is cut from an extruded profiled bar and wherein the supporting surfaces are formed by the extrusion, and wherein the fiber guiding surface is provided with at least one recess leaving a gap to the opening roller housing for permitting the entry of air, said recess being connected to the external atmosphere.

10. The adapter according to claim 6, wherein the fiber guiding surface is provided with a recess for permitting the entry of air, said recess being connected to the external atmosphere.

* * * * *